US009512750B2

(12) United States Patent
Flora

(10) Patent No.: US 9,512,750 B2
(45) Date of Patent: Dec. 6, 2016

(54) INTEGRALLY CAST BLOCK-HEAD WITH SOLENOID PACK COVER

(71) Applicant: Ryan A Flora, Peoria, IL (US)

(72) Inventor: Ryan A Flora, Peoria, IL (US)

( * ) Notice: Subject to any disclaimer, the term of this patent is extended or adjusted under 35 U.S.C. 154(b) by 306 days.

(21) Appl. No.: 13/917,967

(22) Filed: Jun. 14, 2013

(65) Prior Publication Data

US 2013/0333646 A1 Dec. 19, 2013

Related U.S. Application Data

(60) Provisional application No. 61/689,866, filed on Jun. 14, 2012.

(51) Int. Cl.

| | |
|---|---|
| ***F02F 11/00*** | (2006.01) |
| ***F02F 1/42*** | (2006.01) |
| ***F01L 9/04*** | (2006.01) |
| ***F01L 3/00*** | (2006.01) |
| ***F02F 1/00*** | (2006.01) |
| *F02M 61/14* | (2006.01) |

(52) U.S. Cl.

CPC ..... *F01L 9/04* (2013.01); *F02F 1/002* (2013.01); *F02M 61/14* (2013.01)

(58) Field of Classification Search

CPC ..... F01L 9/04; F02F 1/002; F02F 1/102; F02F 1/06; F02F 1/004; F02F 1/045

USPC ..... 123/90.11, 193.3, 305, 41.69, 41.72,123/188.2

See application file for complete search history.

(56) References Cited

U.S. PATENT DOCUMENTS

| | | | | |
|---|---|---|---|---|
| 3,875,641 | A * | 4/1975 | Gregg | B25B 27/06 29/234 |
| 3,949,715 | A | 4/1976 | Faix et al. | |
| 3,983,852 | A | 10/1976 | Chatourel | |
| 4,092,956 | A | 6/1978 | List et al. | |
| 4,446,828 | A | 5/1984 | Bauder et al. | |
| 4,630,579 | A | 12/1986 | Atkin | |
| 5,143,033 | A | 9/1992 | Catterson et al. | |
| 5,404,846 | A | 4/1995 | VanRens | |
| 5,875,746 | A * | 3/1999 | Izuo | F01L 9/04 123/193.5 |
| 6,073,595 | A | 6/2000 | Brogdon | |
| 6,223,713 | B1 | 5/2001 | Moorman et al. | |

(Continued)

*Primary Examiner* — Lindsay Low
*Assistant Examiner* — Syed O Hasan
(74) *Attorney, Agent, or Firm* — Meroni & Meroni, P.C.; Charles F. Meroni, Jr.

(57) ABSTRACT

An engine assembly includes a uni-cast, piston-enclosing chamber structure and a solenoid valve pack. The chamber structure includes a piston-receiving chamber, a gas intake port, an intake valve port, a gas exhaust port, and an exhaust valve port. The gas intake port communicates with the intake valve port, and the gas exhaust port communicates with the exhaust valve port. The solenoid pack includes gas intake and gas exhaust solenoid valve assemblies. The solenoid pack is attachable to the chamber structure such that the gas intake valve port axially aligns with a gas intake valve-receiving column, and the gas exhaust valve port axial aligns with a gas exhaust valve-receiving column. The intake valve is bi-directionally displaceable as received in the gas intake valve port and the gas intake valve-receiving column. Similarly, the exhaust valve is bi-directionally displaceable as received in the gas exhaust valve port and gas exhaust valve-receiving column.

20 Claims, 6 Drawing Sheets

(56) References Cited

U.S. PATENT DOCUMENTS

| | | | | |
|---|---|---|---|---|
| 6,382,167 | B1 * | 5/2002 | Tominaga | F02F 1/002 123/193.3 |
| 2001/0037789 | A1 * | 11/2001 | Walker | F02F 1/002 123/195 R |
| 2002/0179044 | A1 * | 12/2002 | Iizuka | F01L 1/053 123/310 |
| 2004/0129240 | A1 | 7/2004 | Hughes et al. | |
| 2010/0024749 | A1 * | 2/2010 | Meisel | F01L 3/10 123/41.82 R |
| 2011/0073064 | A1 | 3/2011 | Mavinahally et al. | |
| 2011/0192361 | A1 | 8/2011 | Sato et al. | |

* cited by examiner

INTEGRALLY CAST BLOCK-HEAD WITH SOLENOID PACK COVER

PRIOR HISTORY

This non-provisional patent application claims the benefit of U.S. Provisional Patent Application No. 61/689,866 filed in the U.S. Patent and Trademark Office on 14 Jun. 2012.

BACKGROUND OF THE INVENTION

Field of the Invention

The present invention relates generally to internal combustion engines. More particularly, the present invention relates to a uni-cast block-head-cover construction usable in combination with a uniquely configured solenoid pack.

Brief Description of the Prior Art

A monobloc engine assembly is an internal-combustion piston engine where some of the major components: cylinder head, cylinder block, or crankcase are formed, usually by casting, as a single integral unit, rather than being assembled later. This has the advantages of improving mechanical stiffness, and also improving the reliability of the sealing between them.

Monobloc techniques date back to the beginnings of the internal combustion engine. Use of the term has changed over time, usually to address the most pressing mechanical problem affecting the engines of its day. There have thus been three distinct uses of the technique, namely, cylinder head and cylinder; cylinder block, and cylinder block and crankcase. In most cases, any use of the term describes a deliberate single-unit construction, opposed to the more common contemporary practice incorporating multiple components. Some of the more pertinent prior art relating to engine assemblies incorporating integrally formed components is briefly described hereinafter.

U.S. Pat. No. 3,949,715 ('715 Patent), which issued to Faix et al., for example, discloses a Manifold Construction for an Internal Combustion Engine. The '715 Patent describes an internal combustion engine having a cylinder head with integral intake manifold and a planar mounting face which is secured to the cylinder block and on which the exhaust manifold is also mounted. The head member incorporates an open bottomed mixture plenum closed by a heated wall of the exhaust manifold for supplying mixture heat. The plenum receives mixture through an inlet tube perforated to distribute recirculated exhaust gases from an annular chamber in the head.

Mixture passes from the plenum through a pair of upwardly angled feeder passages to separate longitudinally aligned distribution passages feeding the intake ports of front and rear groups of cylinders. The head also incorporates an open topped secondary air gallery connected through distribution tubes with the exhaust ports and closed by an extended flange on the engine rocker cover through which air is supplied. The arrangement provides advantages in manufacturing and mixture distribution for improved operation.

U.S. Pat. No. 3,983,852 ('852 Patent), which issued to Chatourel, discloses an Internal Combustion Engine Disposition. The '852 Patent describes an internal combustion engine structure comprising a one-piece cylinder-block and crankcase casting with integral cylinder-head, of light alloy, and incorporating valve guides, induction ports, exhaust ports, spark plug wells, cooling-water chambers open at the upper port of the casting around the valve seatings and closed by a cover, said cooling-water chambers extending axially around the cylinders and outside the areas corresponding to the induction and exhaust ports and also to the spark-plug wells, said casting further comprising in said areas around said cylinders a wall port provided with cooling fins, whereby the casting can be obtained directly from a light alloy in a chill-mould, notably according to the known high-pressure casting process.

U.S. Pat. No. 4,092,956 ('956 Patent), which issued to List et al., discloses a Water Cooled Internal Combustion Engine, Particularly a Diesel Engine. The '956 Patent describes a water cooled internal combustion engine comprising a cylinder head cast integrally with both the cylinder block and the housing of an overhead camshaft, and which includes a cooling water room extending over all cylinders of the engine, a cooling water distributor channel extending in the longitudinal direction of the engine and arranged immediately above the exhaust ducts, which themselves extend transversely of the engine to an exterior cylinder head side wall, and jet bores communicating the distributor channel with the cooling water room of each cylinder.

U.S. Pat. No. 4,446,828 ('828 Patent), which issued to Bauder et al., discloses a Reciprocating Internal Combustion Engine. The '828 Patent describes a reciprocating piston internal combustion engine to be installed horizontally in a motor vehicle wherein the cylinder block, the cylinder head, one half of the crankcase and the oil sump are formed from a single casting. The oil sump is positioned below the cylinder block and having an opening in the same plane as a flat surface on the cylinder head which locates a camshaft case. The camshaft case and the oil sump cover are formed as one unit, and a stay between the camshaft case and the oil sump cover accommodates the drive shaft of an oil pump located in the oil sump and driven by the camshaft. A second stay between the camshaft case and the oil sump cover contains a duct for conveying oil from the camshaft case back into the oil sump.

U.S. Pat. No. 5,143,033 ('033 Patent), which issued to Catterson et al., discloses an Internal Combustion Engine Having an Integral Cylinder Head. The '033 Patent discloses an internal combustion engine having an integral cylinder head, a one-piece connecting rod, and a crankshaft disposed at the interface between the first engine housing and the second engine housing. In an overhead cam shaft embodiment, the cam shaft drive means includes first and second gearsets of cross-helical gears.

Also directly mounted to the cam drive shaft are the oil slinger, the centrifugally-responsive speed governor components, and the auxiliary power take-off shaft. This arrangement eliminates the need for additional shafts and subassemblies. In another embodiment, both the crankshaft and the cam shaft are disposed at the interface between the two engine housings to decrease manufacturing and assembly costs. The crankshaft and/or cam shaft bearings are formed integral with the engine housings to eliminate the need for separate bearing components.

U.S. Pat. No. 5,404,846 ('846 Patent), which issued to VanRens, discloses a Four Stroke One-Piece Engine Block Construction. The '846 Patent discloses a four-stroke engine comprising a block having an intermediate port defining a cylindrical bore having an axis, a head end, and a crankcase end, a head end port extending from the head end of the intermediate port in integral one-piece relation thereto and including a planar valve seat surface extending at an acute angle to the axis of the cylindrical bore and having a valve seat with a center and a perimeter defined by a radius extending from the center, and a crankcase end port extending from the crankcase end of the intermediate port in integral one-piece relation thereto and including a partially cylindrical port coaxially aligned with the cylindrical bore, and a recessed port extending from the partially cylindrical port and having a peripheral wall spaced at a distance greater than the radius from a line extending perpendicularly to the valve seat surface and from said valve seat center.

U.S. Pat. No. 6,073,595 ('595 Patent), which issued to Brogdon, describes an Engine Construction. The '595 Patent discloses an in-line opposed cylinder engine constructed of a pair of half blocks which when combined form a pair of spaced cylinder heads and an intermediate crankcase and in which the cylinder heads and the intermediate crankcase are tied together by a plurality of spaced elongated through bolts which extend through the cylinder heads and through the half blocks.

Each cylinder head is integral with the remainder of the half block and is preferably of a composite construction with a core of steel or the like which forms the cylinder bore, the firing deck, the exhaust ports and the valve guide as well as the main bearing supports. A matrix structure of lighter material such as aluminum is cast around the core and forms the induction air passages to the intake ports, the coolant passages, oil passages, and the main bearing bosses.

U.S. Pat. No. 6,223,713 ('713 Patent), which issued to Moorman et al., describes an Overhead Cam Engine with Cast-In Valve Seats. The '713 Patent discloses a single cylinder, internal combustion engine with a dry sump lubrication system. The engine includes an engine housing in which the overhead camshaft and crankshaft are rotatably supported, and the housing includes an integrally formed cylinder and head. A timing belt disposed externally of the engine housing interconnects the crankshaft and camshaft, and a piston connected to the crankshaft reciprocates within an internal bore provided in the engine housing cylinder. The cylinder wall around the internal bore is of a generally uniform thickness and circumscribed by cooling fins such that the cylinder resists bore distortion during operation. Dry sump lubrication is obtained by an external oil reservoir connected to a pump which supplies pressurized oil to the bearing journals of the camshaft.

A port of the oil at the camshaft bearing journals flows through passages provided within the cylinder to lubricate the bearing journals of the crankshaft. The reciprocating motion of the valve assemblies controlling intake and exhaust of the combustion chamber pumps the oil which lubricated the camshaft back to the external reservoir. The reciprocating motion of the piston similarly effects a high pressure within the crankcase cavity to pump oil which has lubricated the crankshaft back to the external reservoir. The inventive engine further provides for the mounting of flywheels within the crankcase cavity in conjunction with an external, lightweight fan for engine housing cooling, as well as employs a cast in valve seat for the overhead valve assemblies.

United States Patent Application No. 2011/0073064, which was authored by Mavinahally et al, describes an Integrally Cast Block and Gaseous Fuel Injected Generator Engine. The engine described by the '064 Publication describes an integrally cast four-stroke engine mono-block including an integrally cast cylinder block, cylinder head, and port of a crankcase including crankcase outboard and inboard walls. At least parts of outer and inner bearing bosses are integrally cast with the cylinder block with the inner bearing boss integrally cast in the inboard wall. At least one cored out longitudinally extending open valve train chamber is disposed between the outboard wall and the cast cylinder block.

United States Patent Application No. 2011/0192361, which was authored by Sato et al., describes a water-cooled four-cycle engine comprising an engine core including a cylinder block, a cylinder head and a first crankcase half body all formed as a unitary part cast integrally; a water jacket including a cylinder jacket and a head jacket is formed in the engine core; and a timing-belt chamber being adjacent to the cylinder jacket is provided in a side port of the engine core.

A first opening port for forming a first semi-peripheral port of the cylinder jacket on a side opposite from the timing-belt chamber by casting out is provided in a side surface of the cylinder block. Second and third opening ports for forming a second semi-peripheral port of the cylinder jacket and the head jacket as well as the timing-belt chamber, respectively, by casting out are provided in an upper surface of the cylinder head.

As will be understood from a consideration of the foregoing art hereinabove being cited as exemplary to the state of the art, there does not appear to be an integral block-head construction of singular, integral construction which so-called uni-cast or mono-block construction outfitted with a fuel injector-carrying solenoid pack for eliminating engine assembly weight, and electronically controlling valves for enhancing and/or customizing valve time. Accordingly, the prior art perceives a need for such a construction as briefly summarized in more detail hereinafter.

SUMMARY OF THE INVENTION

A standard or typical engine assembly includes a block that is cast as a separate unit. A separate cylinder head component of the engine assembly is separately bolted to the block unit. A separate valve cover is then bolted on to the cylinder head component. The interfaces intermediate engine assembly components require special features (e.g. a head gasket) to ensure the assembly remains a relatively closed system.

The cylinder head is typically situated above the cylinder(s) atop the cylinder block for enclosing the cylinder(s) to form the cylindrical combustion chamber. The interface or joint is typically sealed by a head gasket. In most engines, the cylinder head is a complexly machined component that provides space for the passages that feed air and fuel to the cylinder, and that allow the exhaust to escape. The cylinder head can also be a foundation piece to which valves, spark plugs and fuel injectors can be mounted.

The present invention contemplates a removal of all or most of the internal components of an engine assembly thereby drastically reducing the production costs by eliminating a great deal of machine time. To achieve these and other readily apparent objectives, the present invention essentially provides a mono-block construction as basically supported by way of a one-cylinder engine assembly with accompanying solenoid pack.

The engine assembly or combination mono-block construction and solenoid pack according to the present invention comprises a uni-cast piston-enclosing chamber structure and a solenoid pack. The chamber structure comprises a piston-receiving chamber, an intake port, an intake valve port, an exhaust port, and an exhaust valve port. The (air) intake port and the intake valve port are in communication with one another.

The solenoid pack comprises an intake valve-receiving column, an exhaust valve-receiving column, an intake solenoid valve assembly, and an exhaust solenoid valve assembly. The intake solenoid valve assembly comprises a first solenoid and an intake valve. The exhaust solenoid valve assembly comprises a second solenoid and an exhaust valve.

The solenoid pack is attachable to the chamber structure such that the intake valve port is in axial alignment with the intake valve-receiving column. The exhaust valve port is in axial alignment with the exhaust valve-receiving column. The intake valve is bi-directionally displaceable as received in the intake valve port and intake valve-receiving column. The exhaust valve is bi-directionally displaceable as received in the intake valve port and intake valve-receiving column.

It is contemplated that the engine assembly may further preferably comprise certain fuel delivery means as exemplified by a fuel injector, and the chamber structure may preferably comprises a fuel inlet. The fuel delivery means essentially function to deliver fuel to the piston-receiving chamber via the fuel inlet. The fuel delivery means as exemplified by a fuel injector are cooperable with the solenoid pack and positionable thereby in cooperable engagement with the fuel inlet.

The engine assembly according to the present invention may further preferably comprise certain spark delivery means and the piston-receiving chamber may preferably comprise a spark inlet. The spark delivery means essentially function to deliver a spark to the piston-receiving chamber after fuel is delivered thereto via the fuel delivery means.

The engine assembly may further preferably comprise a piston. The piston is received in the piston-receiving chamber and is bi-directionally displaced via forces emanating from the ignited fuel via the spark during a power stroke. Connected to the piston is a connecting rod. The connecting rod is pushed via the displaced piston during the power stroke. The connecting rod is connected to a crankshaft for imparting rotational motion thereto.

BRIEF DESCRIPTION OF THE DRAWINGS

Other features of my invention will become more evident from a consideration of the following brief descriptions of illustrations of the subject invention.

DETAILED DESCRIPTION OF THE PREFERRED EMBODIMENT

Figure 1:
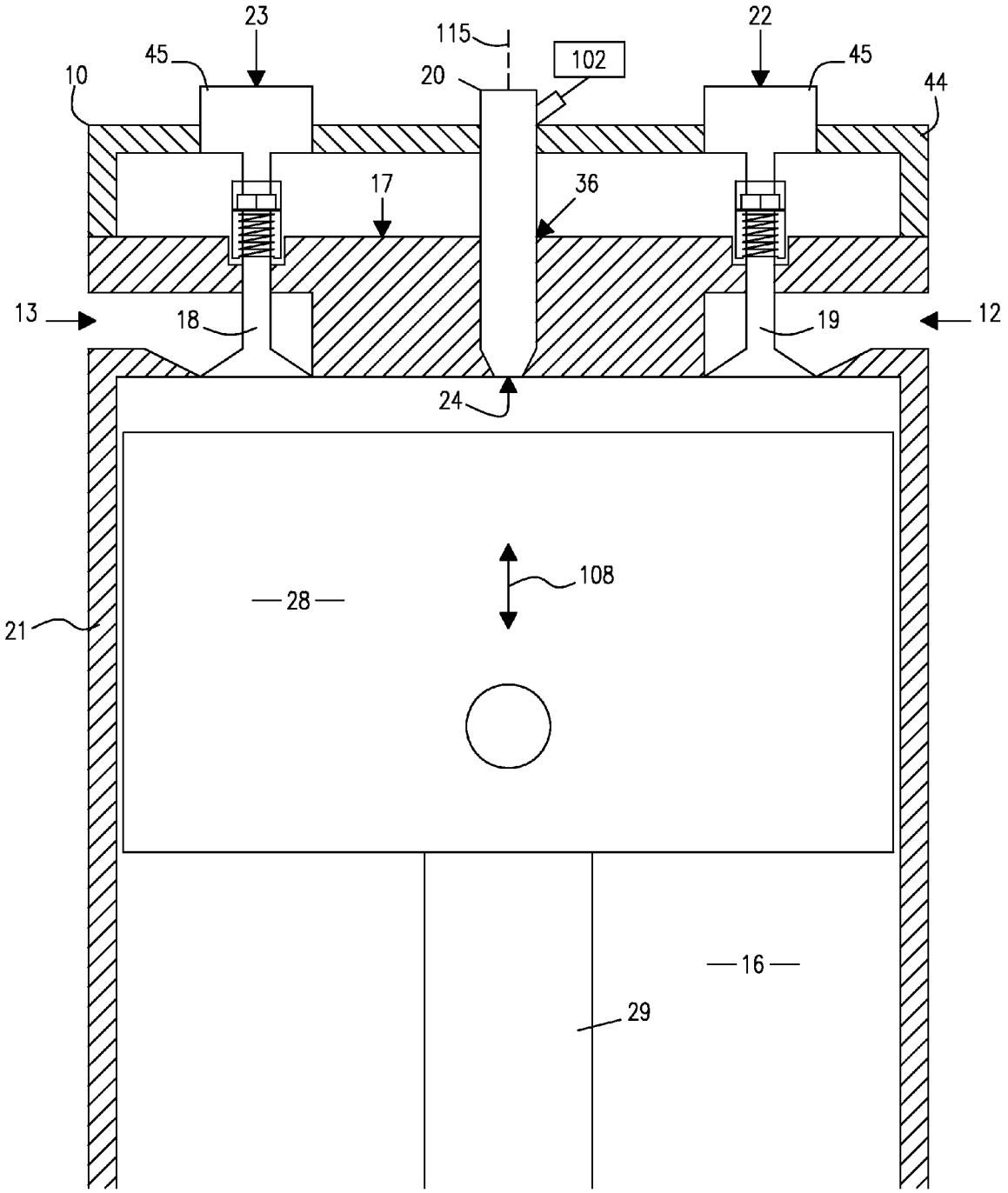
FIG. 1 is a diagrammatic depiction of an integrally cast mono-block construction with attached solenoid pack according to the present invention showing with valve assemblies of the solenoid pack being in axial alignment with the valve intake and exhaust ports of the mono-block construction.
Figure 2:
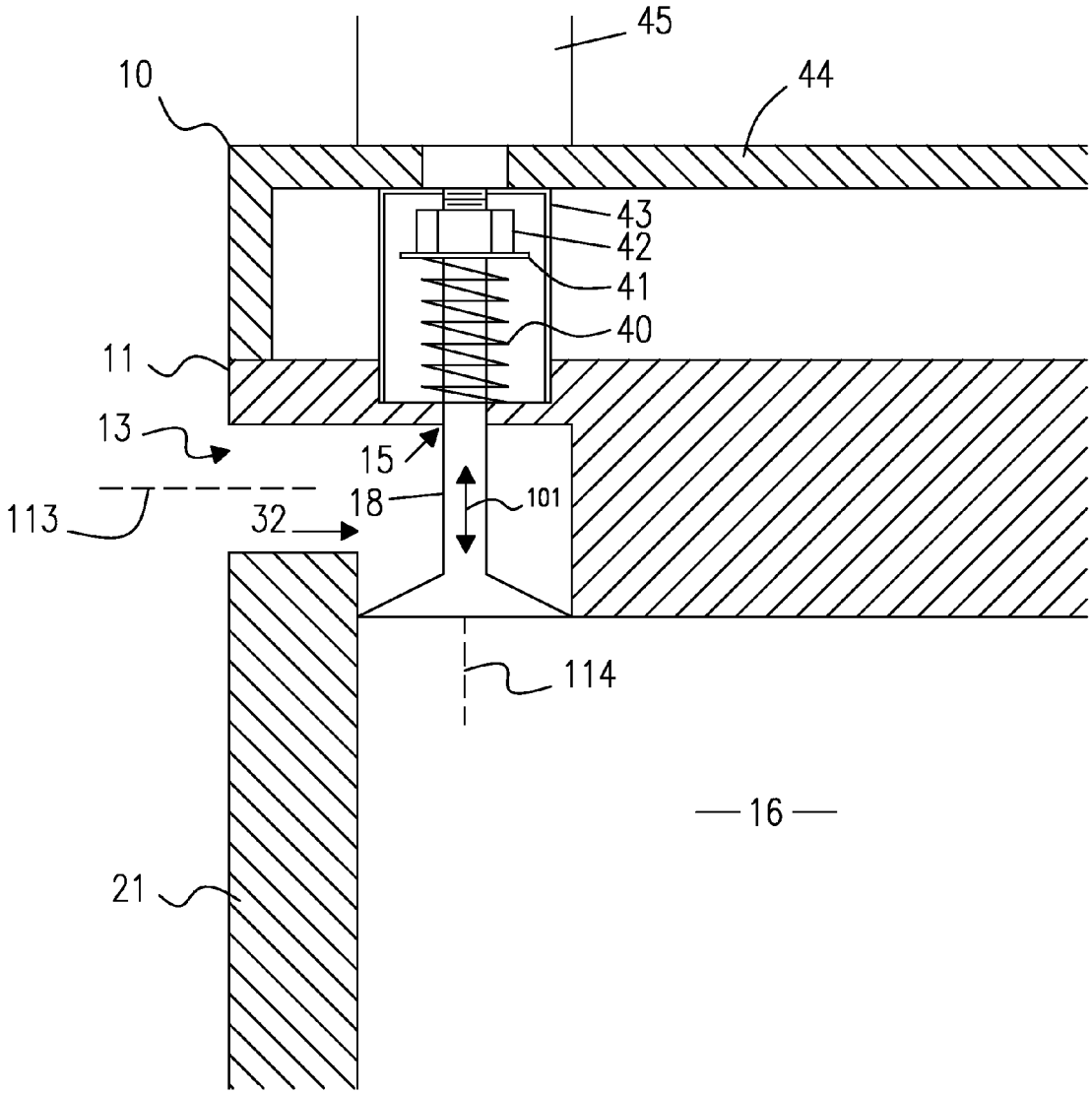
FIG. 2 is an enlarged fragmentary diagrammatic depiction of an exhaust portion of an integrally cast mono-block construction with attached solenoid pack according to the present invention showing a single exhaust valve assembly of the solenoid pack in axial alignment with the valve exhaust port of the mono-block construction, the exhaust valve assembly being shown in an assembled state.
Figure 3:
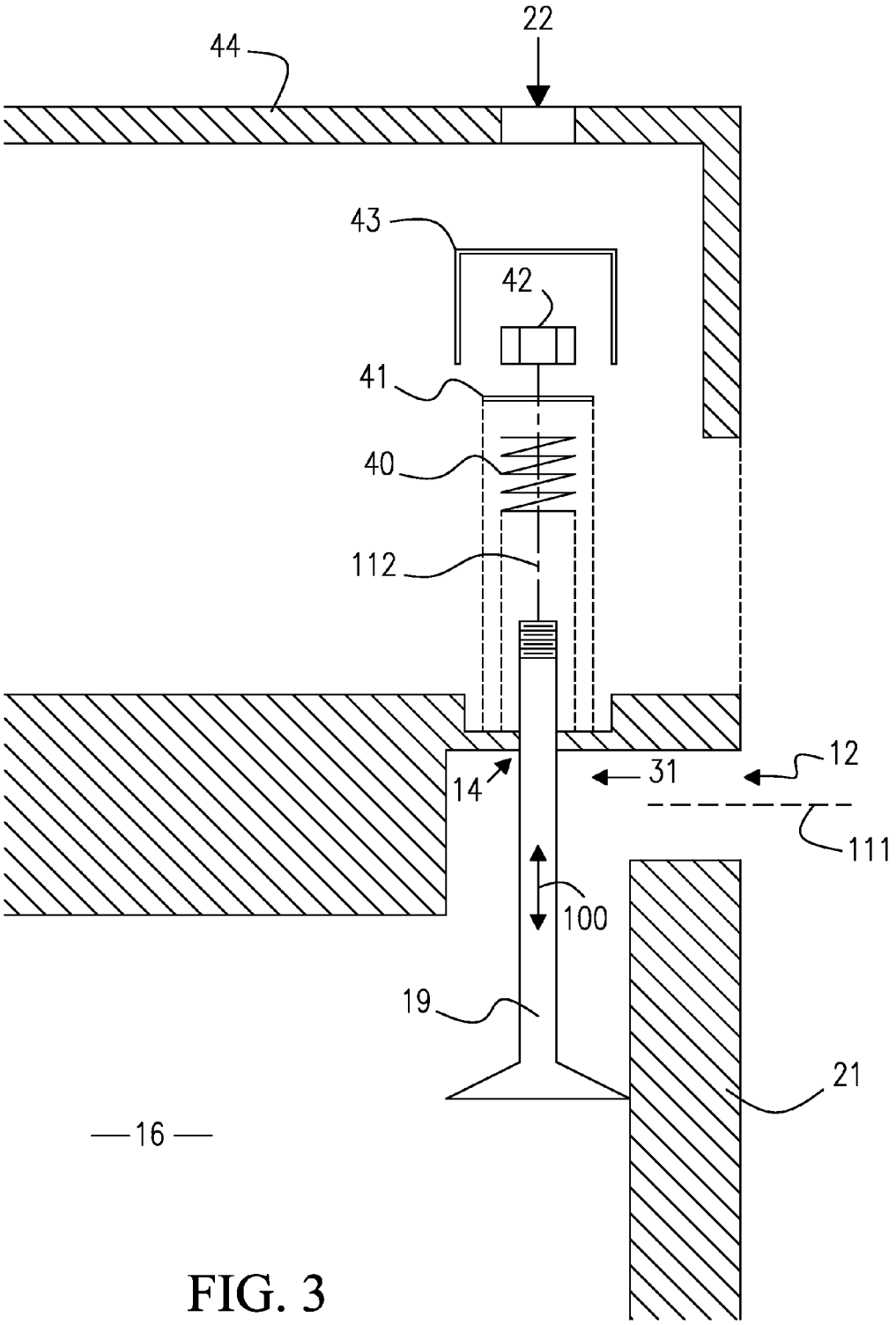
FIG. 3 is an enlarged fragmentary diagrammatic depiction of an intake portion of an integrally cast mono-block construction with attached solenoid pack according to the present invention showing a single intake valve assembly of the solenoid pack in axial alignment with the valve intake port of the mono-block construction, the intake valve assembly being shown in an exploded state.

Referring now to the drawings with more specificity, the preferred embodiment according to the present invention is diagrammatically depicted in FIG. 1. FIG. 1 generally depicts a fragmentary section of a one-cylinder (diesel) engine assembly with a solenoid pack 10 being attached to the uni-cast or mono-block construction 11.

It is contemplated that the simplest way to cast the mono-block construction 11 is to perform a blow casting around the gas intake port 12, gas exhaust port 13, intake valve aperture 14, exhaust valve aperture 15, and cylinder chamber 16. Said casting eliminates the need for the complex machining of a cylinder head.

To eliminate the camshaft, timing gears, push rods, and valve tray, the reader is directed to the solenoid pack 10, which pack 10 is situated atop each cylinder interface site 17. Valves 18 and 19 are insertable from inside the cylinder chamber 16, and preferably threadably inserted or otherwise cooperably associated with the solenoid pack 10. In an alternative method or construction, the valves attach to the block in the conventional manner and a tappet rests on top of each valve. The solenoid actuates against the tappet to open the valve. The valves 18 and 19 are preferably electronically controlled valves for eliminating engine weight and enabling valve time enhancement/customization.

It is contemplated that by attaching an individual solenoid pack 10 to each site 17, maximum efficiency can be achieved. In other words, each solenoid pack 10 can thus be individually controlled by certain computing means (not specifically illustrated) that are already running elsewhere within the engine assembly, and thereby attain maximum efficiency.

The fuel injector as at 20 is preferably situated on or structurally configured to cooperate with the solenoid pack 10 and the entire ensemble is preferably bolted to the site 17 thereby simultaneously effecting proper fuel injector placement. An O-ring gasket can be used in conjunction with the fuel injector 20 so as to hold the fuel injector 20 in place for eliminating unnecessary threading of holes and potential failure points in the engine assembly.

It is further contemplated that the present invention essentially provides an engine assembly or combination mono-block construction and solenoid pack, which engine assembly or combination comprises a uni-cast piston-enclosing chamber structure as at 21 and a solenoid pack as at 10. The chamber structure 21 preferably comprises a piston-receiving chamber as at 16, a gas intake port as at 12, an intake valve port as at 14, a gas exhaust port as at 13, and an exhaust valve port as at 15. The gas or air intake port 12 and the intake valve port 14 being in communication with one another.

The solenoid pack 10 further comprises an intake valve-receiving column as at 22, an exhaust valve-receiving column as at 23, an intake solenoid valve assembly, and an exhaust solenoid valve assembly. The intake solenoid valve assembly comprises a solenoid assembly 45 for effecting linear displacements of the intake valve as at 19; a return spring as at 40; a washer as at 41, a nut as at 42; and a tappet as at 43.

Similarly, the exhaust solenoid valve assembly comprises a solenoid assembly 45 for effecting linear displacements of the exhaust valve as at 18; a return spring 40; a washer 41; a nut 42, and a tappet 43. A bracket 44 mounts the intake and exhaust solenoid valve assemblies to the mono-block construction 11.

The solenoid pack 10 is attachable to the chamber structure 21 such that the intake valve port 14 is in axial alignment with the intake valve-receiving column 22. The exhaust valve port 15 is in axial alignment with the exhaust valve-receiving column 13. The intake valve 19 is bi-directionally displaceable (as at vectors 100) as received in the intake valve port 14 and intake valve-receiving column 12. The exhaust valve 18 is bi-directionally displaceable (as at vectors 101) as received in the intake valve port 15 and intake valve-receiving column 23.

It is contemplated that the engine assembly may further preferably comprise certain fuel delivery means as depicted as a generic black box 102, and as further comprising, for example, a fuel injector as at 20. The chamber structure 21 may preferably comprises a fuel inlet as at 24. The fuel delivery means 102 essentially function to deliver fuel 104 to the piston-receiving chamber 16 via the fuel inlet 24. The fuel delivery means 102 as exemplified by a fuel injector 20, in part, are made cooperable with the solenoid pack 10 and positionable thereby in cooperable engagement with the fuel inlet 24.

In the case of non-diesel (i.e. non-adiabatic) type engines, it is contemplated that the engine assembly according to the present invention may further preferably comprise certain spark delivery means as may be generally depicted with a generic block box 103, and as further comprising, for example, a spark plug as at 25. In the case of a gasoline type engine, the piston-receiving chamber 26 may preferably comprise a spark inlet as at 27. The spark delivery means 103 essentially function to deliver a spark 105 to the piston-receiving chamber 16 after fuel 104 is delivered thereto via the fuel delivery means 103 and injector 20, for example. The spark 105 and fuel 104 cause an explosion as at 106 for forcing the piston in a direction 107 away from the explosion 106.

In this last regard, the engine assembly according to the present invention may further preferably comprise a piston as at 28, a connecting rod as at 29, and a crankshaft as at 30. The piston 28 is received in the piston-receiving chamber 16 and is bi-directionally displaceable (as at vectors 108) via forces (as at 107) emanating from the ignited fuel 104 via the spark 105 during a power stroke.

Connected to the piston 28 is a first end of a connecting rod as at 29. The connecting rod 29 is pushed as at 107 via the displaced piston 28 during the power stroke. The second end of the connecting rod 29 is connected to the crankshaft as at 30 for imparting rotational motion as at arrows 109 thereto. The primary axis of rotation of the crankshaft is depicted at 110.

The mono-block construction 11 is central to the present invention and is designed for use with an engine assembly substantially as set forth hereinabove. The mono-block construction according to the present invention preferably comprises a uni-cast piston-enclosing chamber structure 21 or 26 comprising a piston-receiving chamber 16, a gas or air intake port as at 12, an intake valve port as at 14, a gas exhaust port 13, and an exhaust valve port 15. The air intake port 12 and the intake valve port 14 are in communication with one another at an intake junction as at 31.

Figure 4:
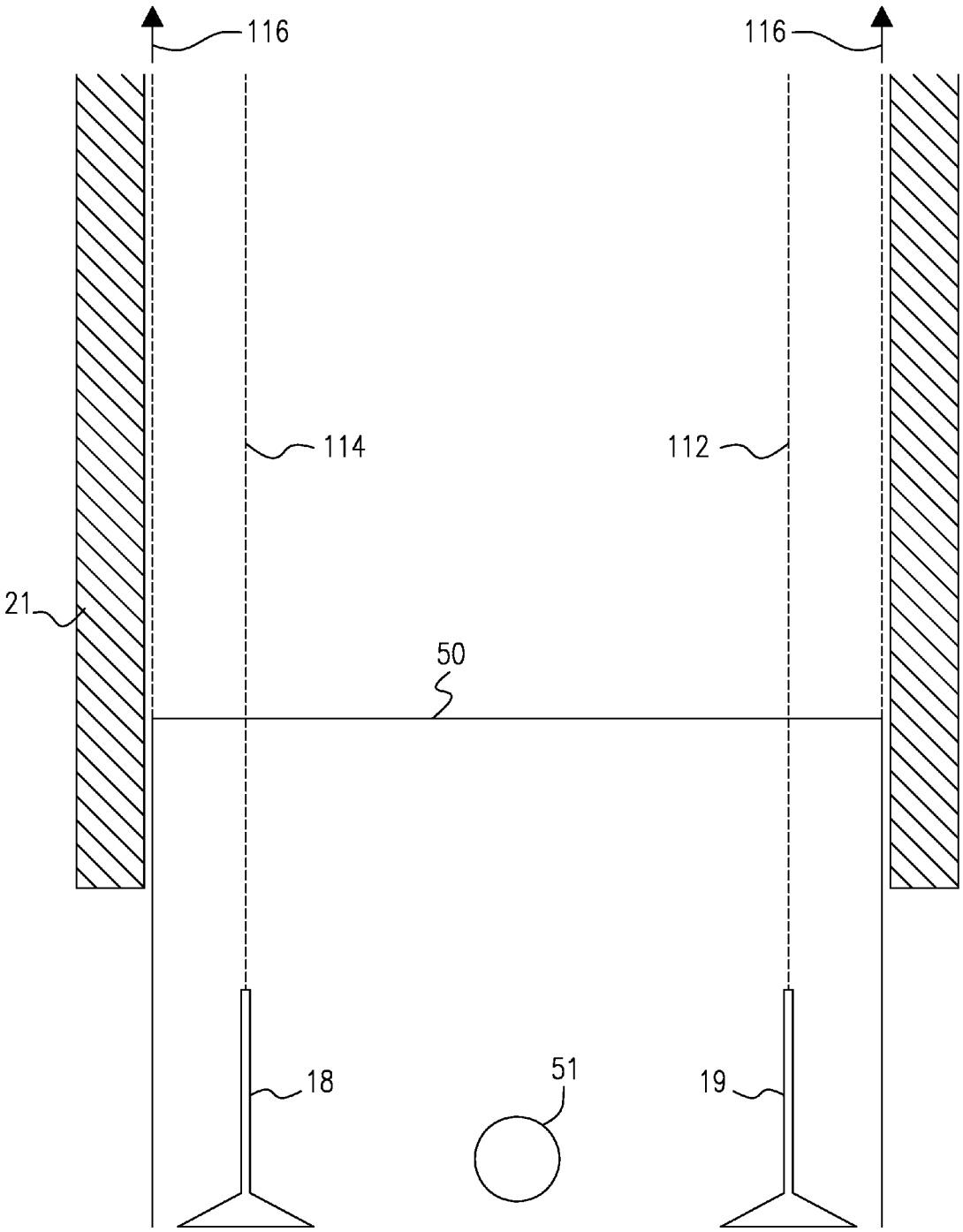
FIG. 4 is a diagrammatic depiction of a cylinder sleeve being pressed into a piston-receiving chamber of the mono-block construction from the bottom thereof, with intake and exhaust valves being also installed after the cylinder sleeve from the bottom of the piston-receiving chamber of the mono-block construction.
Figure 5:
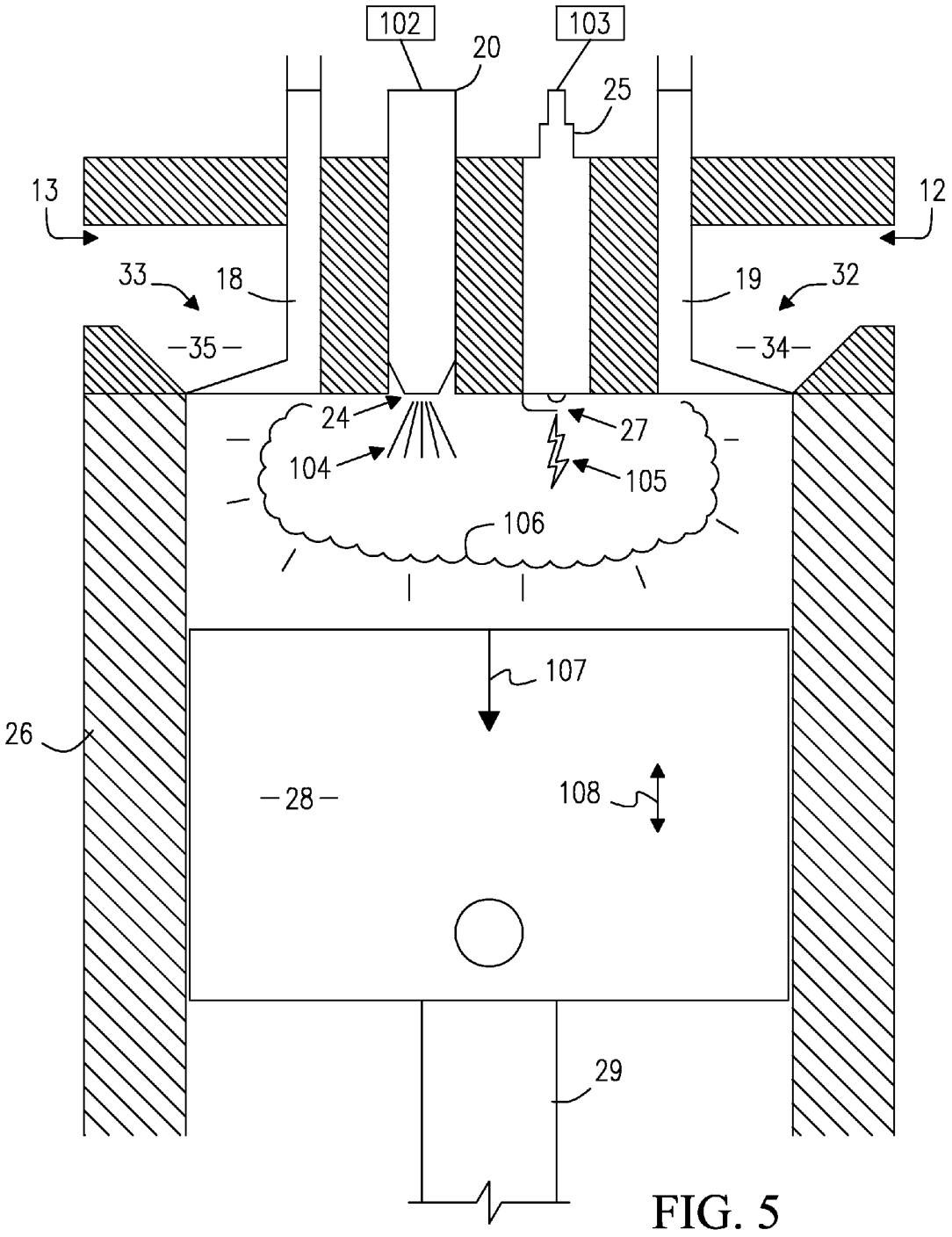
FIG. 5 is a diagrammatic depiction of an integrally cast mono-block construction for use with gasoline engines according to the present invention showing with valve assemblies of the solenoid pack being in axial alignment with the valve intake and exhaust ports of the mono-block construction.
Figure 6:
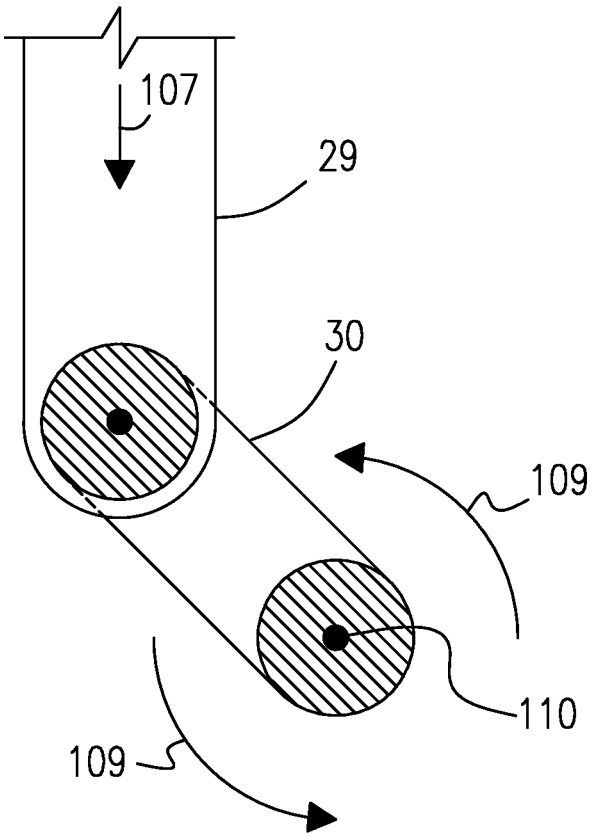
FIG. 6 is an enlarged fragmentary diagrammatic depiction of the lower end of a connecting rod as attached to a crankshaft for imparting rotational motion to the crankshaft via downwardly directed forces transmitted through the connecting rod.

Referencing FIG. 4, it will be seen that an optional cylinder sleeve 50 may be installed within the piston-enclosing chamber structure 21 (or 26). In this regard, the cylinder sleeve 50 is pressed into the chamber structure 21 (or 26) from the bottom, the vectors 116 showing the direction of sleeve press into the chamber 21 (or 26). The valves 18 and 19 are installed after sleeve 50 installation along the respective axes. The sleeve 50 is preferably outfitted with an aperture 51 for cooperative engagement with a T-bar and/or slide hammer for sleeve 50 removal, if necessary The air intake port 12 comprises an intake axis as at 111, and the intake valve port 14 comprises an intake valve axis as at 112. The intake axis 111 and intake valve axis 112 are preferably orthogonal to one another. The gas exhaust port 13 and the exhaust valve port 15 are in communication with one another at an exhaust junction 32. The gas exhaust port 13 comprises an exhaust axis 113, and the exhaust valve port 15 comprises an exhaust valve axis 114. The exhaust axis 113 and exhaust valve axis 114 are preferably orthogonal to one another.

The intake junction 32 comprises an intake tunnel 34 and the exhaust junction 33 comprises an exhaust tunnel 35. The intake tunnel 34 is preferably obliquely angled from the intake port 12 to the intake junction 32, and the exhaust tunnel 35 is preferably obliquely angled from the exhaust port 13 to the exhaust junction 33. A fuel injector-receiving port at 36 comprises an injector axis as at 115. The injector axis 115 is preferably parallel to the intake valve and exhaust valve axes 112 and 114. The injector axis 115 may be preferably situated substantially equidistant intermediate the intake and exhaust valve axes 112 and 114.

While the foregoing specifications set forth much specificity, the same should not be construed as setting forth limits to the invention but rather as setting forth certain preferred key components and features. Accordingly, although the invention has been described by reference to certain preferred embodiments, it is not intended that the novel arrangements be limited thereby, but that modifications thereof are intended to be included as falling within the broad scope and spirit of the foregoing disclosures, the appended drawings, and the following claim limitations.

I claim:

1. An engine assembly, the engine assembly comprising, in combination:

a uni-cast, piston-enclosing chamber structure, the chamber structure comprising a piston-receiving chamber, a gas intake port, an intake valve port, a gas exhaust port, and an exhaust valve port, the gas intake port and the intake valve port being in communication with one another, the gas exhaust port, and the exhaust valve port being in communication with one another; and a convectively air cooled solenoid pack, the solenoid pack comprising a gas intake valve-receiving column, a gas exhaust valve-receiving column, a gas intake solenoid valve assembly, and a gas exhaust solenoid valve assembly, the gas intake solenoid valve assembly comprising a first solenoid assembly and an intake valve, the gas exhaust solenoid valve assembly comprising a second solenoid assembly and an exhaust valve, the solenoid pack being attachable and externally mounted to the chamber structure such that the intake valve port is in axial alignment with the gas intake valve-receiving column, and the exhaust valve port is in axial alignment with the gas exhaust valve-receiving column, the intake valve being bi-directionally displaceable as received in the intake valve port and gas intake valve-receiving column, the exhaust valve being bi-directionally displaceable as received in the exhaust valve port and gas exhaust valve-receiving column, and wherein a uni-cast bracket mounts the gas intake solenoid valve assembly and the gas exhaust solenoid valve assembly to the uni-cast, piston-enclosing chamber structure, and wherein the uni-cast bracket includes an open-ended side opposite a close-ended side, and wherein the uni-cast bracket is oriented such that the open-ended side abuts the piston-enclosing chamber structure.

2. The engine assembly of claim 1 comprising fuel delivery means and the chamber structure comprises a fuel inlet, the fuel delivery means for delivering fuel to the piston-receiving chamber via the fuel inlet, wherein the solenoid pack is bolted to the uni-cast, piston-enclosing chamber structure, and each solenoid is electrically insulated from the remaining portions of the engine assembly in the case of coil burn out.

3. The engine assembly of claim 2 wherein the fuel delivery means comprises a fuel injector, the fuel injector being cooperable with the solenoid pack and positionable thereby in cooperable engagement with the fuel inlet.

4. The engine assembly of claim 3 comprising spark delivery means and the piston-receiving chamber comprises a spark inlet, the spark delivery means for delivering a spark to the piston-receiving chamber after fuel is delivered thereto via the fuel delivery means.

5. The engine assembly of claim 4 comprising a piston, the piston being received in the piston-receiving chamber, the piston being displaced via forces emanating from the ignited fuel via the spark during a power stroke; the piston receiving chamber further comprising a cylinder sleeve, the cylinder sleeve having at least one aperture cooaperable with a T-bar or slide hammer.

6. The engine assembly of claim 5 comprising a connecting rod, the connecting rod being connected to the piston, the connecting rod being pushed via the displaced piston during the power stroke.

7. The engine assembly of claim 6 wherein the piston-enclosing chamber structure is liquid-cooled.

8. A combination mono-block construction and solenoid pack for use with an engine assembly, the combination mono-block construction and solenoid pack comprising:

a uni-cast, piston-enclosing chamber structure, the chamber structure comprising a piston-receiving chamber, a gas intake port, an intake valve port, a gas exhaust port, and an exhaust valve port, the gas intake port and the intake valve port being in communication with one another, the gas exhaust port, and the exhaust valve port being in communication with one another; and a convectively air cooled solenoid pack, the solenoid pack comprising an intake valve-receiving column, an exhaust valve-receiving column, an intake solenoid valve assembly, and an exhaust solenoid valve assembly, the intake solenoid valve assembly comprising a first solenoid assembly and an intake valve, the exhaust solenoid valve assembly comprising a second solenoid assembly and an exhaust valve, the solenoid pack being attachable and externally mounted to the chamber structure such that the intake valve port is in axial alignment with the intake valve-receiving column, and the exhaust valve port is in axial alignment with the exhaust valve-receiving column, the intake valve being bi-directionally displaceable as received in the intake valve port and intake valve-receiving column, the exhaust valve being bi-directionally displaceable as received in the intake valve port and intake valve-receiving column, and wherein an open ended uni-cast bracket mounts the intake solenoid valve assembly and the exhaust solenoid valve assembly to the uni-cast, piston-enclosing chamber structure.

9. The combination of claim 8 comprising fuel delivery means and the chamber structure comprises a fuel inlet, the fuel delivery means for delivering fuel to the piston-receiving chamber via the fuel inlet, and wherein the solenoid pack is bolted to the uni-cast, piston-enclosing chamber structure, and wach solenoid is electrically insulated from the mono-block construction in the case of coil burn out.

10. The combination of claim 9 wherein the fuel delivery means comprises a fuel injector, the fuel injector being cooperable with the solenoid pack and positionable thereby in cooperable engagement with the fuel inlet.

11. The combination of claim 10 comprising spark delivery means and the piston-receiving chamber comprises a spark inlet, the spark delivery means for delivering a spark to the piston-receiving chamber after fuel is delivered thereto via the fuel delivery means.

12. The combination of claim 9 comprising a piston, the piston being received in the piston-receiving chamber, the piston being displaced via forces emanating from ignited fuel during a power stroke.

13. The combination of claim 12 comprising a connecting rod, the connecting rod being connected to the piston, the connecting rod being pushed via the displaced piston during the power stroke.

14. The combination of claim 13 comprising a crankshaft, the connecting rod being connected to the crankshaft for imparting rotation motion thereto.

15. A mono-block construction for use with an engine assembly, the mono-block construction comprising: a uni-cast, piston-enclosing chamber structure, the chamber structure comprising a piston-receiving chamber, a gas intake port, an intake valve port, a gas exhaust port, and an exhaust valve port, the air intake port and the intake valve port being in communication with one another at an intake junction, the gas intake port comprising an intake axis, the intake valve port comprising an intake valve axis, the intake axis and intake valve axis being orthogonal to one another, the gas exhaust port and the exhaust valve port being in communication with one another at an exhaust junction, the gas exhaust port comprising an exhaust axis, the exhaust valve port comprising an exhaust valve axis, the exhaust axis and exhaust valve axis being orthogonal to one another, and wherein an open-ended bracket externally mounts a convectively air cooled solenoid pack to the uni-cast, piston-enclosing chamber structure.

16. The mono-block construction of claim 15 wherein the intake junction comprises an intake tunnel and the exhaust junction comprises an exhaust tunnel, the intake tunnel being obliquely angled from the intake port to the intake junction, and the exhaust tunnel being obliquely angled from the exhaust port to the exhaust junction; and wherein the air cooled solenoid pack comprises a gas intake valve-receiving column, a gas exhaust valve-receiving column, a gas intake solenoid valve assembly, and a gas exhaust solenoid valve assembly, the gas intake solenoid valve assembly comprising a first solenoid assembly and an intake valve, the gas exhaust solenoid valve assembly comprising a second solenoid assembly and an exhaust valve, the intake valve port being in axial alignment with the gas intake valve-receiving column, and the exhaust valve port being in axial alignment with the gas exhaust valve-receiving column.

17. The mono-block construction of claim 16 comprising a fuel injector-receiving port, the fuel injector-receiving port comprising an injector axis, the injector axis being parallel to the intake valve and exhaust valve axes.

18. The mono-block construction of claim 17 wherein the injector axis is substantially equidistant intermediate the intake and exhaust valve axes.

19. The mono-block construction of claim 15 comprising, in combination, the solenoid pack, the solenoid pack comprising an intake valve-receiving column, an exhaust valve-receiving column, an intake solenoid valve assembly, and an exhaust solenoid valve assembly, the intake solenoid valve assembly comprising a first solenoid assembly and a gas intake valve, the exhaust solenoid valve assembly comprising a second solenoid assembly and a gas exhaust valve, the solenoid pack being attachable to the chamber structure such that the intake valve port is in axial alignment with the intake valve-receiving column, and the exhaust valve port is in axial alignment with the exhaust valve-receiving column, the gas intake valve being bi-directionally displaceable as received in the intake valve port and intake valve-receiving column, the gas exhaust valve being bi-directionally displaceable as received in the intake valve port and intake valve-receiving column.

20. The mono-block construction of claim 19 comprising fuel delivery means, and the piston-receiving chamber comprises a fuel inlet, fuel being deliverable to the piston-receiving chamber via the fuel delivery means and fuel inlet; and wherein the solenoid pack is bolted to the uni-cast, piston-enclosing chamber structure, and each solenoid is electrically insulated from the mono-block construction in the case of coil burn out.

* * * * *